United States Patent [19]

Schmutzler

[11] Patent Number: 4,563,033

[45] Date of Patent: Jan. 7, 1986

[54] APPLIANCE CARRIER AND STORAGE DEVICE

[76] Inventor: Richard W. Schmutzler, R.D. 2 Box 245, Walton, N.Y. 13856

[21] Appl. No.: 595,057

[22] Filed: Mar. 30, 1984

[51] Int. Cl.[4] ..... A45C 11/24

[52] U.S. Cl. ..... 294/146; 294/137; 294/164

[58] Field of Search ..... 294/146, 137, 148, 167, 294/164; 408/238, 239 R, 239 A; 224/268, 247, 907; 206/581, 427; 211/175; 248/220.4, 294

[56] References Cited

U.S. PATENT DOCUMENTS

| | | | |
|---|---|---|---|
| 3,025,998 | 3/1962 | Petersen | 294/146 |
| 3,128,822 | 4/1964 | Mastrud, Jr. | 294/164 |
| 3,181,756 | 5/1965 | Smilg | 294/146 |
| 4,357,044 | 11/1982 | Woodworth | 294/137 |

OTHER PUBLICATIONS

U.S. General Tool Catalog, pp. 24 and 31.

*Primary Examiner*—James B. Marbert

[57] ABSTRACT

A device for carrying and storing pistol shaped appliances such as an air chisel, an electric hand drill, a soldering gun or an electric hair dryer. The appliance is held or clamped to a rigid planar structural member, with the grip and barrel axes oriented substantially parallel to the structural member. The device is carried and stored with the plane of the structural member generally vertical. A reel means can be provided, by a plurality of projections from the structural member near it's periphery for receiving the electric cord or air hose of the pistol shaped appliance as it is wound. The structural member can contain a hand hole for carrying or positioning over a cantilevered support when storing against a generally vertical surface. Projections can be added to the structural member for carrying accessories or retaining the end of the electric cord or air hose.

8 Claims, 21 Drawing Figures

Fig.2f
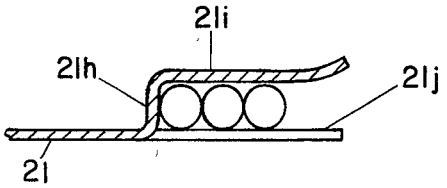
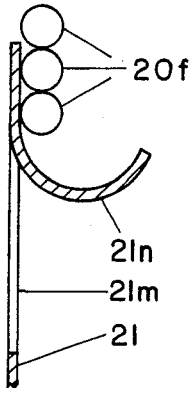
Fig.2h
Fig.2g
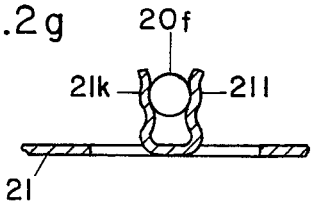
Fig.2e
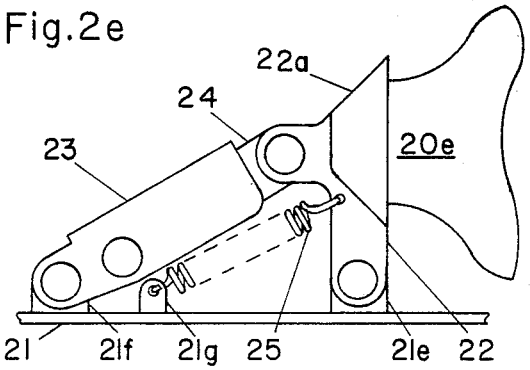
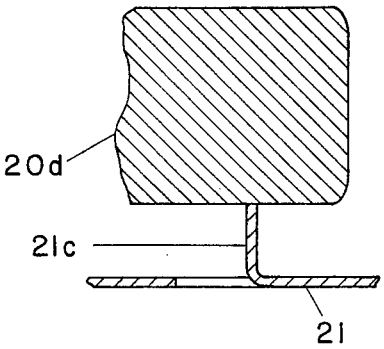
Fig.2c
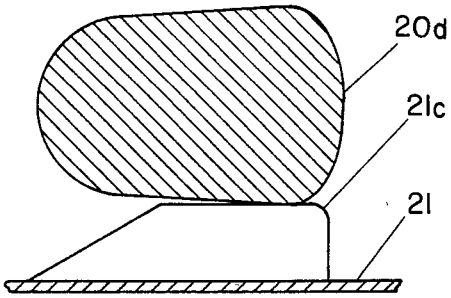
Fig.2d
Fig.3
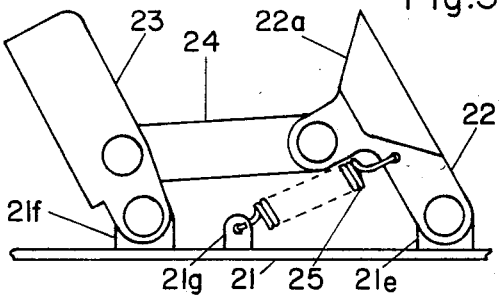

Fig.4a
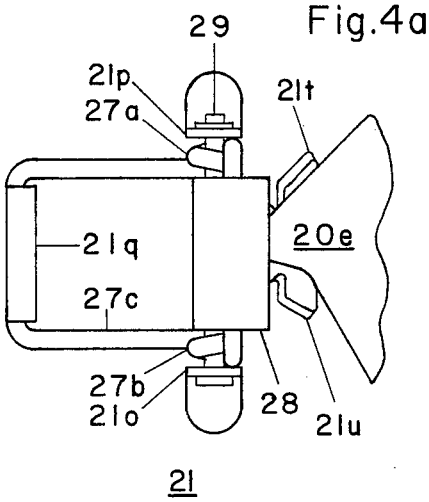
Fig.5a
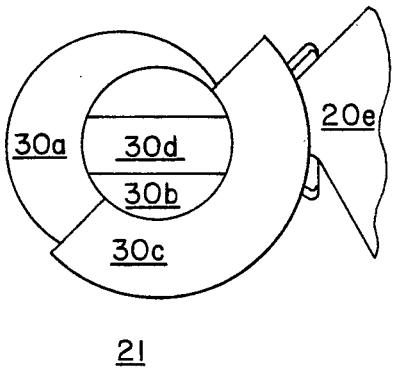
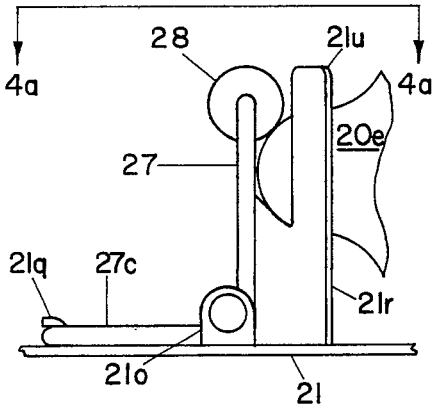
Fig.4
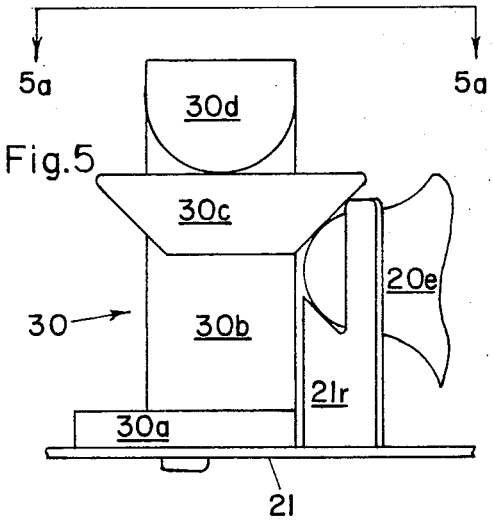
Fig.5

APPLIANCE CARRIER AND STORAGE DEVICE

FIELD OF THE INVENTION

My invention relates to carrying and storing devices, and more particularly to an improved arrangement for carrying and storing pistol shaped appliances.

DISCUSSION OF PRIOR ART

A pistol shaped appliance, as used herein, is defined as a device comprising 2 elongated members whose longitudinal axes intersect at an angle between 45 and 135 degrees. The fingers of the hand wrap around one of the elongated members, called the grip, as a means of holding the device. The other elongated member, called the barrel, performs the function for which the appliance was designed. The energy to operate the pistol shaped appliance may be supplied from a variety of sources which include electricity, compressed air or the operator's hand. Over the years a number of appliances have evolved into a pistol shape. A few examples, but not to be construed as limited to this list are: an electric hand drill, a soldering gun, a hot melt glue gun, an automotive timing light, an air chisel, an impact wrench, and a hair dryer. One reason for the evolution of the pistol shape is that it is well adapted to the human hand allowing the user to get a firm, convenient grip on the appliance for ease and accuracy in directing it's use. Another reason is that the use of a power appliance becomes a one hand operation; the operator is able to be turn the appliance on and off with the same hand that grips it. Still other reasons are that the hand does not obstruct vision in the work area and the same powerful gripping force which holds the appliance can supply the energy to operate it and resist any torque developed in it's operation. Tools which have evolved into a pistol shape have done so primarily, as shown above, because of their compatability for use with the human hand. Because the human body is mobile and pistol shaped appliances have been designed to be used in the human hand almost any where it is, it follows that it would be desirable to have a safe, convenient, durable, inexpensive method of carrying and storing these appliances.

The pistol shape, while it is well adapted to the hand for use and carrying, does not lend itself well to storage. If an electric cord or air hose is attached, it does not lend itself well to carrying either. Pistols are typically carried in a holster attached to the body by a belt and or by various means of straps. They are stored by laying the holster on a flat surface or suspending it with its associated belt and or straps from an appropriate support. This method is not practical for pistol shaped appliances which tend to be larger, bulkier and may have electric cords or air hoses attached to them. In addition, the function of a pistol is such that it should be easily available for quick access over extended periods of time, while the functions of most pistol shaped appliances are such that they are used at one location, picked up and stored until needed again, then carried to the same or a new location to be used again and the cycle repeated.

Heretofore the methods of carrying or storing pistol shaped appliances have been:

A. without a carrying device

B. in a metal, wood or plastic 'box type' carrying case with any accessories carried separately or loose in the carrying case C. encased in a formed wire 'cage like' carrying case D. electric drills have been suspended from a keeper clamped in the chuck or inserted into a holster or a holster like caddy as would be done with a pistol.

A. Without a carrying device, a pistol shaped appliance is easy to carry only when an electric cord or air hose is not attached. It is also difficult to store on a visible storage board, like a pegboard. On a cabinet shelf it tends to be pushed back out of sight, and in a drawer, it tends to be covered up. Without a carrying device, carrying a pistol shaped appliance with an electric cord or air hose attached can result in an unsafe condition. If the cord drags behind it may be stepped on, caught on something, pulling the something over, or pulling the appliance out of the hand that is carrying it. A second hand can carry the cord or it may be coiled and carried with the same hand that is carrying the appliance, but that is inconvenient. The cord may be wrapped around the appliance, but that may make the appliance awkward to hold and may put short radius bends in the cord that could shorten the life of the cord. In a drawer, on a cabinet shelf, or on the top of a bench the cord can become entangled with other items stored there, causing problems in the removal of the appliance and possible damage to the appliance or the other items and even injury to the person removing the appliance.

B. Typical metal, wood or plastic 'box type' carrying cases for pistol shaped appliances have no means of securing the appliance or accessories from bouncing or rattling around in the case with consequent damage.

C. Formed wire 'cage like' carrying cases take room on the workbench or shelf, do not lend themselves well to carrying accessories and tend to be more expensive because of the amount of labor required in assembly.

D. The keeper type carrier for electric drills which clamps in the chuck is somewhat inconvenient to use. It requires that the chuck key be used each time the keeper is secured into or removed from the chuck and works only with appliances that have a chuck to clamp it in. The cord hangs loose in hanks below the drill which could be an unsafe condition when the drill is carried. The holster and holster like caddy are inconvenient to carry if not fastened to the belt. The holster allows the cord to hang loose the same as the keeper type and is inconvenient to store. The holster like caddy allows the drill to rattle freely in it.

OBJECTS

Accordingly several objects of my invention are to provide a carrying and storage device for pistol shaped appliances which allows easy convenient insertion and removal of the appliance, that holds the appliance securely, that provides a safe, convenient, one hand carrying means and that has convenient means for storage on the wall for visibility and access.

A further object of my invention is to provide a carrying and storage device for pistol shaped appliances that has a convenient cord storage reel with large bend radii for the cord minimizing the possibility of cord damage, allows fast cord winding, and has convenient means to secure the end of the cord.

Still another object of my invention is to provide a carrying and storage device for a pistol shaped appliance that may be incorporated into a appliance case to secure the appliance from bouncing and rattling around in the case.

A further object of my invention is to provide a carrying and storage device for pistol shaped appliances that provides convenient storage for the accessories associated with that particular appliance eg: drill chuck key, 3 prong electrical adapter, drills, solder, hot melt glue, chisels, impact sockets and the like.

Another objective of my invention is the provision of a novel carrying and storage device for pistol shaped appliances of the above character that has a minimum of parts, that is simple to construct, and that can be tooled for high volume inexpensive manufacture on standard machinery.

Further objects and advantaged of my invention will become apparent from a consideration of the drawings and ensuing description thereof.

FIGURES

FIG. 1 is a front elevation view of an embodiment of the carrying and storing device for pistol shaped appliances designed to carry and store an air chisel and accessories. The air chisel and accessories are shown in place.

FIGS. 1*a* through 1*f* are section views taken as indicated by similarly designated section lines in FIG. 1 and enlarged.

FIG. 2 is a front elevation view of an embodiment of the carrying and storing device for pistol shaped appliances designed to clamp an electric hand drill for carrying and storage. The electric hand drill is shown in place.

FIG. 2*a* is a view of the barrel projection taken at lines 2*a*—2*a* in FIG. 2 with the drill removed.

FIGS. 2*b* through 2*d* and 2*f* through 2*h* are section views taken as indicated by similarly designated section lined in FIG. 2 and enlarged.

FIG. 2*e* is a view taken at lines 2*e*—2*e* in FIG. 2 and enlarged.

FIG. 3 is a view of the force producing means of FIG. 2*e* in the released position.

FIG. 4 is a view taken at lines 2*e*—2*e* in FIG. 2 of a force producing means in an alternate embodiment of the invention and enlarged.

FIG. 4*a* is a view taken at lines 4*a*—4*a* in FIG. 4.

Figure 2:
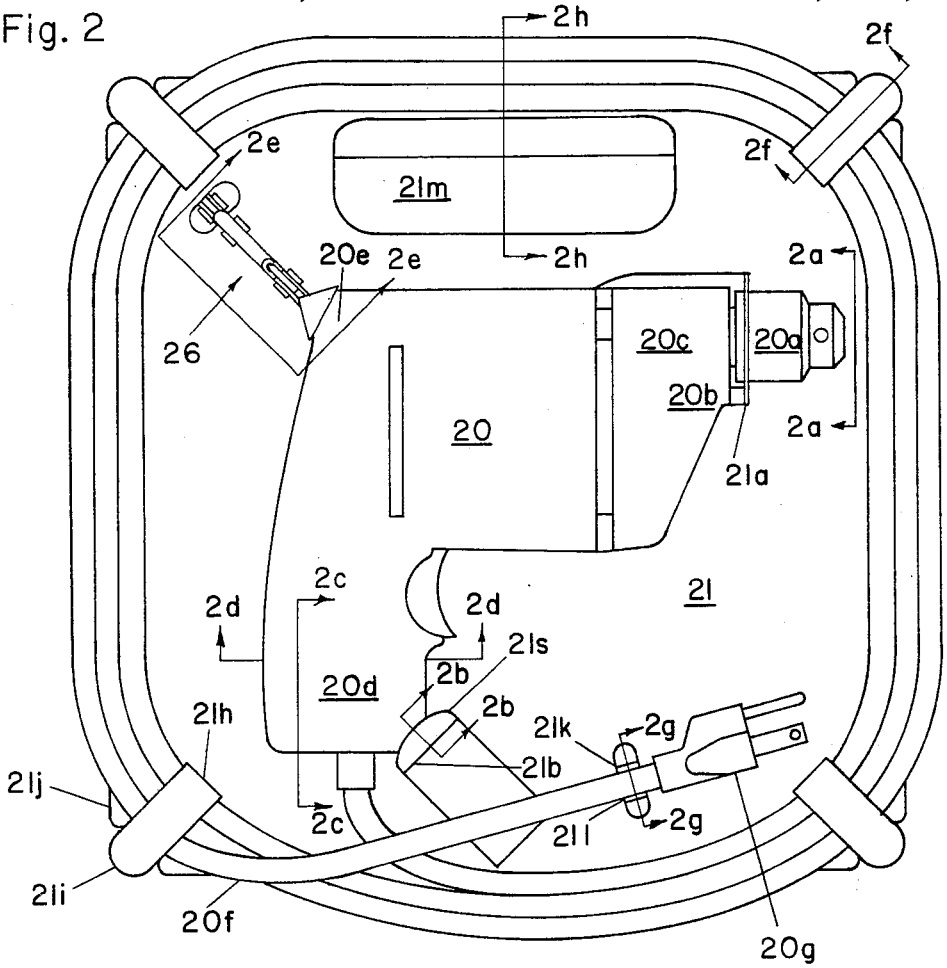

FIG. 5 is a view taken at lines 2*e*—2*e* in FIG. 2 of a force producing means in a second alternate embodiment of the invention and enlarged.

FIG. 5*a* is a view taken at lines 5*a*—5*a* in FIG. 5.

DESCRIPTION

Figure 1:
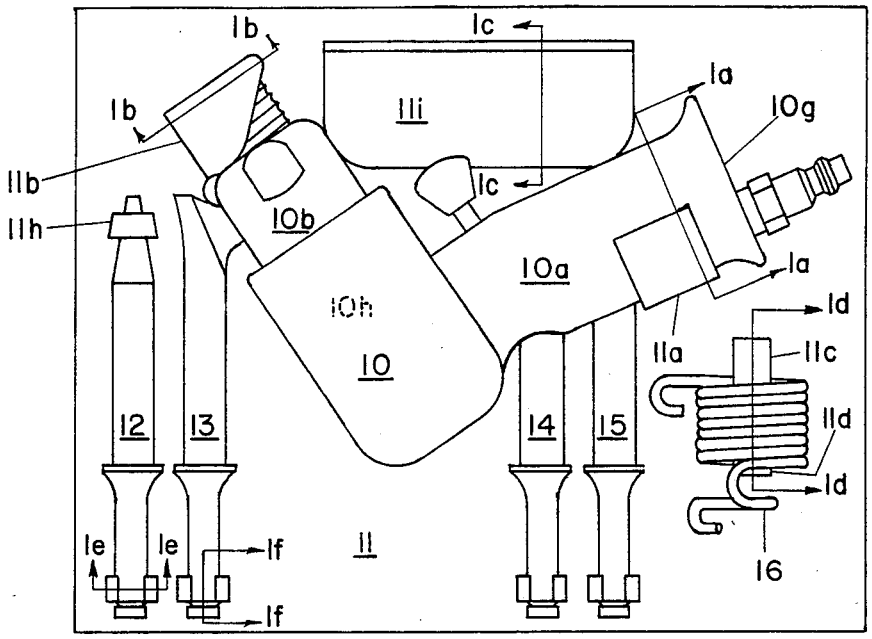

FIG. 1 shows an injection molded embodiment of my invention designed to support air chisel 10 and hold it to structural member 11 for carrying and storage. Structural member 11 is rigid and planar in shape and is the backbone of the device. Projections 11*a* through 11*h*, 11*j* and 11*k* as shown in FIGS. 1 and 1*a* through 1*f*, project from structural member 11 and perform various functions as are hereinafter described. Structural member 11 contains hand hole 11*i*. Air chisel 10 comprises grip 10*a*, barrel 10*b*, grip projection retention contact area 10*c*, grip projection support contact area 10*d*, barrel projection retention contact area 10*e*, barrel projection support contact area 10*f*, grip to structural member contact area 10*g* and barrel to structural member contact area 10*h*. Chisels 12 through 15 and chisel retaining spring 16 are shown in place.

FIG. 2 shows a formed sheet metal embodiment of my invention designed to clamp electric hand drill 20 to structural member 21 for carrying and storage. Structural member 21 is also rigid and planar in shape and the backbone of the device just as structural member 11 is in FIG. 1. Projections 21*a* through 21*c*, 21*e* through 21*h*, 21*k*, 21*l* and 21*n* as shown in FIGS. 2 and 2*a* through 2*h*, project from structural member 21 and perform various functions as are hereinafter described. Reel side tab 21*i* is formed on the outboard end of reel projection 21*h*. Grip stop tab 21*s* is formed on the outboard end of grip stop projection 21*b*. Structural member 21 contains hand hole 21*m* and reel side area 21*j*. Overcenter toggle force producing means 26 is shown in FIGS. 2, 2*e* and 3 comprising clamp link 22 pivotally attached to structural member 21 through clamp link projection 21*e*, toggle operating link 23 pivotally attached to structural member 21 through toggle operating link projection 21*f*, toggle link 24 pivotally attached to both clamp link 22 and toggle operating link 23 and return spring 25 pivotally attached to both structural member 21 through spring projection 21*g* and to clamp link 22. Clamp nest 22*a* is a part of clamp link 22. Electric hand drill 20 comprises drill chuck 20*a*, enlarged barrel area 20*b*, drill barrel 20*c*, drill grip 20*d*, drill clamp area 20*e*, electric cord 20*f* and cord plug 20*g*.

An alternate embodiment of a force producing means is seen in clamp spring 27 of FIGS. 4 and 4*a*. Clamp roller 28 can rotate about an axis parallel to structural member 21 on the ends of clamp spring 27. The clamp spring is attached to structural plate 21 through spring attachment projections 21*o*, 21*p*, spring hold down projection 21*q* and attachment pin 29. Appliance guide projection 21*r* projects from structural member 21.

A second alternate embodiment of a force producing means is seen in clamp cam 30 of FIGS. 5 and 5*a*. Clamp cam 30 is pivotally attached to structural member 21 and pivots on an axis which is perpendicular to structural member 21. Clamp cam 30 comprises disc 30*a*, cam cylinder 30*b*, hold down collar 30*c* and knob 30*d*. Appliance guide projection 21*r* projects from structural member 21.

OPERATION

The invention for carrying and storing a pistol shaped appliance with the grip and barrel axes oriented substantially parallel to a rigid structural member is disclosed in two basic embodiments. The first, as seen in FIG. 1, supports and holds the pistol shaped appliance (air chisel 10) to structural member 11 by gravity, spring pressure and friction. The second, as seen in FIG. 2, is the preferred embodiment and clamps the pistol shaped appliance (electric hand drill 20) firmly to structural member 21 such that it is constrained to move with the structural member.

Figure 1A:
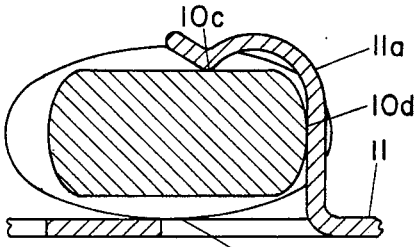
Figure 1B:
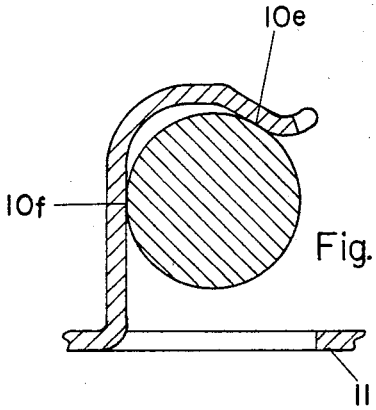

In FIG. 1 the grip and barrel axes of air chisel 10 are substantially parallel to rigid planar structural member 11. The air chisel is supported by grip projection 11*a* and barrel projection 11*b* which also hold it against structural member 11 for carrying and storing. FIGS. 1*a* and 1*b* show a cross section through structural member 11 and projections 11*a* and 11*b* respectively to be generally "J" shaped. Air chisel 10 contacts the structural member under grip to structural member contact area 10*g* and barrel to structural contact area 10*h* in FIG. 1. Grip projection 11*a* is designed to distort slightly to apply a force grip 10*a* of the air chisel at grip projection retention contact area 10*c*. Location 10*c* is between 10*g* and 10*h* but off to one side of the line between them. To resist the tendency of the air chisel to pivot about 10*g* and 10*h* from the force applied at 10*c*, barrel projection 11*b* is designed to apply a force against barrel 10*b* at barrel projection retention contact area 10*e*. The forces applied at 10*c* and 10*e* are: located on opposite sides of the line between 10*g* and 10*h*, balance each other out and hold the air chisel against the structural member at 10*g* and 10*h*. Barrel projection 11*b* is designed so contact point 10*e* is beyond the barrel centerline resulting in a component of force tending to hold the barrel against the barrel projection at barrel projection support contact area 10*f*. This also results in a detent being formed which must be overcome for the air chisel to be inserted or removed. The air chisel is held to the structural member by the grip and barrel projections which contact it at two places 10*c* and 10*e* on the side away from the structural member. When the structural member is in a substantially vertical orientation with the handle up, the air chisel is supported by the grip and barrel projections at grip projection support contact area 10*d* and barrel projection support contact area 10*f*, by friction between the air chisel and the structural member at 10*g* and 10*h* and by friction between the grip and the grip projection at 10*c*. There is no detent designed into grip projection 11*a* because the width of the grip would make it unwieldy to insert or remove the air chisel if the grip projection went across the whole grip. The cantilever design of such a projection would also make it weak. If deemed necessary or desirable, a detent can be incorporated to retain the grip. A slight depression in the structural member under, or a small rise on the structural member ahead of, grip to structural member contact area 10*g*, where the grip contacts the structural member in the inserted position, will provide the detent. In like manner, the detent for the barrel could be moved from the barrel projection to the structural member. The free ends of the grip and barrel projections are bent away from the structural member to provide easier access when inserting the air chisel, see FIGS. 1*a* and 1*b*.

From the foregoing, it will be apparent to one skilled in the art that structural members with properly positioned projections, whose cross section with the structural member are generally "J" shaped, can be designed to hold any pistol shaped appliance to the structural member by contacting the pistol shaped appliance at two places on the side away from the structural member. Special cases exist where a generally "J" shaped projection need contact the pistol shaped appliance only at one place on the side away from the structural member to hold it to the structural Member. Two special cases are when the projection contact location is: 1. on the line between the two contacts the pistol shaped appliance makes with the structural member and 2. within the triangle formed by three contacts the pistol shaped appliance makes with the structural member.

Figure 1C:
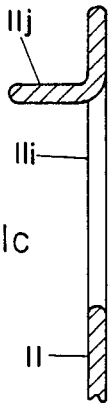

FIG. 1 shows structural member 11 to contain hand hole 11*i* through which the user's fingers may be inserted to grip the structural member for carrying with the plane of the structural member generally vertical, or which may be positioned over a cantilevered support for storing against a generally vertical surface like a pegboard. Handle projection 11*j* at the top edge of the hand hole in FIGS. 1 and 1*c* provides a wider bearing surface to protect the fingers while carrying.

Figure 1D:
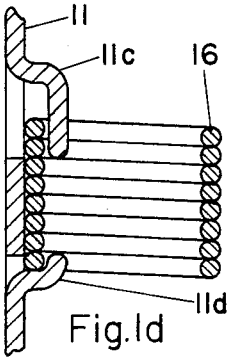
Figure 1E:
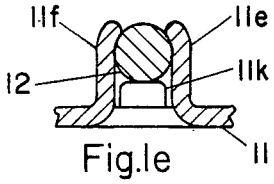
Figure 1F:
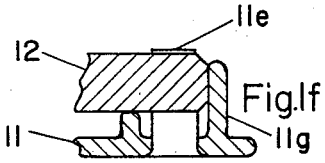

FIGS. 1, 1*e* and 1*f* show how chisel 12 is secured to structural member 11 by projections 11*e*, 11*f*, 1*g* and 11*h*. The pointed end of chisel 12 slides under chisel hold down strap 11*h* which holds it to the structural member. The shank end of chisel 12 is pushed down between chisel holder projections 11*e* and 11*f*. The free ends of the chisel holder projections are formed with detents on the inside of each opposing pair and spaced so that as the chisel is, inserted the chisel holder projections must flex slightly to allow the shank to pass, then they close to hold the shank firmly. Chisel support projection 11*k* supports the chisel away from the structural member so the ring on the shank of the chisel will clear the structural member. The chisel holder projections are positioned as close to the shank end of the chisel as practical to reduce the force required to hold the chisels to the structural member during a shock load that would tend to remove them. Axial chisel stop projection 11*g* restricts the downward motion of the chisel while the chisel hold down strap restricts the upward motion relieving the chisel holder projections of these functions. Chisels 13, 14 and 15 are held to the structural member in the same manner as chisel 12, but the chisel hold down strap is designed and located to suit each particular chisel. The business end and the chisel hold down straps of chisels 13, 14 and 15 are located in the space under the air chisel to make the device more compact. Retaining spring 16, used with the air chisel, is held to the structural member by top and bottom spring holding projections 11*c* and 11*d* as shown in FIGS. 1 and 1*d*. The spacing between projections 11*c* and 11*d* is such that when the retaining spring is positioned completely toward projection 11*c* the other end of the spring will clear projection 11*d* to be inserted or taken out. Projection 11*c* is just long enough to contact the inside of the retaining spring and prevent the end from moving far enough from the structural member to clear the free end of projection 11*d* until additional force is applied to bend the spring for insertion or removal. One skilled in the art will easily see how the principles employed to fasten the chisels and chisel retaining spring to the structural member can be adapted to fasten the accessories for any pistol shaped appliances to a plane shaped structural member.

Figure 2A:
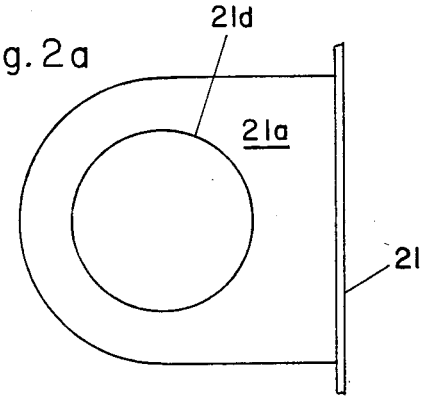
Figure 2B:
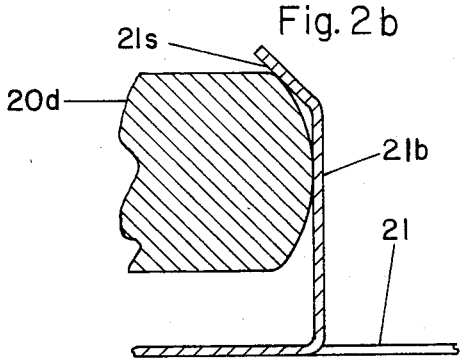

FIG. 2 shows electric hand drill 20 clamped to rigid planar structural member 21 with the grip and barrel axes oriented substantially parallel to the structural member. Barrel projection 21*a*, grip stop projection 21*b* and grip support projection 21*c* provide location for the electric hand drill and structure against which overcenter toggle force producing means 26 releasably clamp the electric hand drill. As seen in FIG. 2*a* barrel projection 21*a* contains barrel aperture 21*d* through which drill chuck 20*a* is inserted. The barrel projection supports the barrel and restricts it to axial movement of the drill chuck through the barrel aperture. A component of the force which clamps the electric hand drill pushes the enlarged barrel area 20*b* of the electric hand drill against the barrel projection thereby eliminating the axial movement of the drill chuck through the barrel. The locating and clamping functions of grip stop projection 21*b* and grip support projection 21*c* can best be understood by refering to FIGS. 2, 2*b*, 2*c* and 2*d*. Grip stop projection 21*b* has grip stop tab 21*s* on the free end which acts to cam drill grip 20*d* against the grip support projection as the drill grip is pushed against the grip stop tab by the clamping force. The clamping force produced by overcenter toggle force producing means 26 is directed substantially parallel to the structural member and between the barrel projection and the grip stop projection. This clamping force first pushes the enlarged portion of the barrel against the barrel projection then pivots the electric hand drill, about the contact point between the drill chuck and the barrel aperture, until it is stopped by the grip stop tab. The sloped edge of the grip support projection provides for easier insertion of the drill by camming the grip up to the top of the grip support if necessary. It can be seen in FIG. 2 that the grip stop projection is at an angle to the barrel axis of the drill. This provides for easier insertion of the drill by camming the grip into clamping position if necessary.

Refer to FIGS. 2 and 2*e* in the explanation of the operation of overcenter toggle force producing means 26 that follows. Overcenter toggle force producing means 26 comprises clamp link 22, toggle operating link 23, toggle link 24 and return spring 25. Clamp link 22 and toggle operating link 23 are pivotally attached to structural member 21 at toggle link projection 21*e* and toggle operating link projection 21*f* respectively. Toggle link 24 is pivotally attached between the clamp link and the toggle operating link as shown. Return spring 25 is pivotally attached between the clamp link and spring projection 21*g* on the structural member to return the clamp link to an out of the way position when the overcenter toggle force producing means is released. Clamp nest 22*a* is a part of clamp link 22. Clamp nest 22*a* has four inwardly sloping sides that center the clamp nest on drill clamp area 20*e* of the drill as the clamp link is pivoted against the drill in clamping. It also prevents motion of the drill clamp area perpendicular to the structural member when the drill is clamped. Starting with the force producing means in the releases position of FIG. 3, the toggle operating link is pivoted toward the drill causing the toggle link to pivot the clamp link against the drill. As the pivot point between the toggle operating link and the toggle link goes a small distance beyond the centerline between the pivot points on the opposite ends of these two links, the bottom of the channel, from which the toggle operating link is made, contacts the toggle link stopping further rotation of the toggle operating link. The reaction force of the drill pushing against the clamp link puts the combination of the toggle and toggle operating links in compression. This compressive force in combination with the overcenter location of the pivot point between the toggle and toggle operating links causes a component of the compressive force to hold the bottom of the toggle operating link channel against the toggle link forming an overcenter locking toggle. The clamp link, the barrel projection, the grip stop projection and the grip support projection working together clamp the drill rigidly to the structural member such that it is constrained to move with the structural member. To release the overcenter locking toggle the user need only overcome the component of compressive force holding the toggle operating link against the toggle link.

The following are considerations for designing and locating the clamping elements:

A. The invention discloses a device that clamps a pistol shaped appliance with the grip and barrel axes oriented substantially parallel to a rigid planar structural member. The degree of parallelism is determined by the height of the barrel aperture, the grip support projection, and the clamp nest above the structural member. These must all be coordinated to achieve clamping and the desired degree of parallelism. They may be designed to allow the side of the pistol shaped appliance either to touch the structural member or clear it as the designer desires. The height of the grip stop tab above the structural member must also be coordinated with the above for proper clamping. The grip support projection is not essential for the function of the device. It's function is to set the height of the grip above the structural member which is a component in the parallelism of the pistol shaped appliance to the structural member and the general appearance of the combination.

B. While a variety of arrangements for the toggle and toggle operating links could be made to work, the arrangement shown in FIG. 2*e* appears to work best. The short distance between the pivot points on the toggle operating link together with it's long length give it good mechanical advantage in operation. The arrangement also requires that the toggle operating link be pushed toward the pistol shaped appliance to clamp it and pulled away from it to release it which is a good human factors consideration. The length and arrangement of the links and the location of the pivot projections must also be coordinated to provide sufficient clearance when the clamp is released for inserting the pistol shaped appliance. At the same time the pivot point between the clamp link and the toggle link, while in the released position, should be designed to be far enough from a line between the pivot points on the opposite ends of these links so that the toggle operating link will operate freely.

C. The force producing means should be located relative to the barrel and the grip stop projections such that clamping the pistol shaped appliance against them will distort them slightly to develop the force with which the appliance will be clamped.

D. In cases where it is undesirable to stop the enlarged barrel area against the barrel projection, or there is no enlarged barrel area to stop against, the device will work equally as well if a separate barrel stop projection is provided for the end of the barrel to stop against after it passes through the barrel projection.

E. The barrel projection will provide the necessary clamping function if the barrel aperture does not completely encircle the barrel but is open on the same side of the barrel as the force producing means. The advantages of the completely encircling barrel aperture are a stronger barrel projection and easier insertion of the appliance because a closed aperture is a better target.

F. Most electric hand drills have a groove around the barrel between the drill chuck and the enlarged barrel area. It is important that the barrel projection be thicker than the width of this groove to prevent the barrel projection from entering the groove and hampering the removal of the drill. In applications with a thin barrel projection, tabs can be used at the edge of the barrel aperture to provide the effect of making the barrel projection thicker.

G. The grip support projection should be placed far enough from the end of the grip so the grip has to rest on it as the appliance is inserted. If the end of the grip misses the grip support projection, the appliance cannot be inserted and clamped properly.

H. Clamp link 22 as shown has a complete nest 22*a* to engage the drill clamp area. It is possibly to make a clamp link function with a structural member that has a clamping projection under the drill clamp area. The side of the nest which is closest to the structural member is removed from the clamp nest and incorporated in the clamping projection. The side members of the nest may also be incorporated in the clamping projection leaving the clamp link with only the portion of the original nest that holds the drill against the structural member.

I. The embodiment shown in FIG. 2 uses the force producing means to push against drill clamp area 20*e* of electric hand drill 20. While this is the preferred method, it would be possible to design an embodiment which incorporates the force producing means pushing against the grip of the drill. Projections at drill clamp area 20*e* would retain the drill the desired distance from the structural member and allow the drill clamp area to slide parallel to the structural member until the force developed at the barrel projection balanced the force applied by the force producing means.

A plurality of reel projections 21*h*, reel side tabs 21*i* and reel side areas 21*j* together with the cord retention projections 21*k* and 21*l* as can be seen in FIGS. 2, 2*f* and 2*g* cooperate to form a reel and retention means for receiving and securing the electric cord of the electric hand drill as it is wound. The reel projections 21*h* are spaced in from the periphery of structural member 21 allowing the portion of the structural member, reel side area 21*j*, between the periphery of the structural member and the reel projection to form one side of the reel. Reel side tab 21*i* on the free end of the reel projection is formed parallel to the structural member and pointing away from the center of the structural member to act as the other side of the reel. The distance between the reel side tab and the reel side area is slightly greater than the diameter of electric cord 20*f* allowing the cord to enter freely. The free end of the reel side tab is formed at an angle generally away from the structural member allowing easier access for the cord to enter. Cord retention projections 21*k* and 21*l* have a lead in angle and opposing circular sections slightly smaller than the cord diameter to allow a section of electric cord 20*f* near cord plug 20*g* to be easily inserted and retained, preventing the cord plug from flapping and maintaining the cord tight on the reel. The length of the cord and the location of the cord retention projections must be coordinated in the design of any particular embodiment to insure that the cord end will come in the right location to be retained. This coordination can be reduced by using a cord plug which has cord retention projections molded on it allowing the cord plug to be clamped to the previous coil of cord at any location except where a reel projection would interfere. The reel projections could be designed to extend further from the structural member allowing the coils of the cord to lay beside each other. With the reel projections designed for the coils to lay side by side, there is no assurance, however, that one coil will not be wound on top of another thus adding an uncontrollable variable in coordinating the length of the cord with the location of the cord retention projections. The embodiment shown is preferred because the coil positions are controlled by the reel side tab and the reel side area thereby insuring the length of cord wound on the reel will be more consistent. The shorter reel projections are also stronger and less susceptible to damage.

The device for carrying and storing pistol shaped appliances may be made entirely of metal, such as aluminum or steel, by stamping and forming it from a sheet or fabricating it from pieces, but I prefer for most applications that it be made of various plastics, by injection molding, for example. All of the various projections are preferably molded integrally with the structural member. While various portions of the device may have been shown with sharp edges and corners for convenience in drafting, it will be apparent that such edges and corners may be rounded to insure that persons will not be cut or scratched. Clamp link 22, toggle operating link 23 and toggle link 24 would typically be made separately from the structural plate and assembled to each other and to the clamp link and toggle operating link projection pivot points with separate or integrally molded pivot pins.

FIG. 2 shows structural member 21 to contain hand hole 21*m* through which the user's fingers may be inserted to grip the structural member for carrying with the plane of the structural member generally vertical, or which may be positioned over a cantilevered support for storing against a generally vertical surface like a pegboard. Handle projection 21*n* at the top edge of the hand hole in FIGS. 2 and 2*h* provides a wider bearing surface to protect the fingers while carrying. While the handle on the embodiments of the invention shown in FIGS. 1 and 2 imply the device is made to carry or store by the handle, this invention for holding or clamping a pistol shaped appliance substantially parallel to a rigid planar structural member may be incorporated in a carrying case for carrying or storing the appliance. It may be an integral part of the carrying case or designed to be removed from the carrying case.

FIG. 4 and 4*a* illustrate an alternate embodiment of a force producing means which may be used to push electric hand drill 20 against barrel projection 21*a* and grip stop projection 21*b* thereby producing the force necessary to clamp the drill. Clamp spring 27 is a torsional spring with clamp spring coils at 27*a* and 27*b*. Attachment pin 29 retains the clamp spring to the structural member through clamp spring coils 27*a* and 27*b* at spring attachment projections 21*o* and 21*p*. Spring loop 27*c* of the clamp spring is held to the structural member by spring hold down projection 21*q*. Clamp roller 28 is free to rotate on the ends of the clamp spring. Guide projection 21*r* has two vertical sides which retain drill clamp area 20*e* generally in the center of clamp roller 28. The bottom of the guide projection is sloped so that downward force on the drill clamp area will cam the drill against the barrel and grip stop projections. The drill is inserted the same as with the overcenter toggle clamp, but the clamping is different. The drill clamp area is pushed against the clamp roller stressing the clamp spring. As the maximum dimension of the drill clamp area passes the roller, the clamp spring forces the roller back over the drill clamp area. The clamp roller comes to rest on the top of the drill clamp area at a point where it applies a downward and sideward force to the drill clamp area clamping the drill between the clamp roller, the guide projection, the barrel projection and the grip stop projection. Roller stop ears 21*t* and 21*u* on guide projection 21*r* allow the clamp spring to be prestressed to apply a greater force to the drill clamp area at the same time holding the roller in a position where the drill clamp area can contact it for proper operation.

FIGS. 5 and 5*a* illustrate a second alternate embodiment of a force producing means which may be used to push electric hand drill 20 against barrel projection 21*a* and grip stop projection 21*b* thereby producing the force necessary to clamp the drill. Clamp cam 30 comprises four functional areas; disc 30*a*, cam cylinder 30*b*, hold down collar 30*c* and knob 30*d* and is pivotally attached to structural member 21. Clamp cam 30 pivots on an axis which is concentric with disc 30*a*. Cam cylinder 30*b* is eccentric to disc 30*a*. Hold down collar 30*c* is concentric with cam cylinder 30*b*, so that as clamp cam 30 is rotated by knob 30*d*, the sloped surface of the hold down collar moves toward or away from drill clamp area 20*e*. The sloped surface on the hold down collar contacts the drill clamp area forcing it down against the sloped surface on appliance guide projection 21*r*. The combined action of these sloped surfaces force drill 20 against the barrel and grip stop projections thereby clamping the drill as the clamp cam is rotated to the clamped position. The hold down collar is cut away and the center of rotation of the clamp cam is located to provide clearance for inserting the drill when the clamp cam is rotated to the released position. Disc 30*a* is provided to increase the resistance of the clamp cam to overturning from the reaction force generated by clamping the appliance. The same clamping action can be accomplished by making the clamp cam rotate on the axis of cam cylinder 30*b* and making hold down collar 30*c* on a helix around the cam cylinder. In designing either clamp cam it is important to have enough combined mechanical advantage in the hold down surface and friction between the clamp cam and the structural member to make the clamp self locking thus preventing the clamp cam from rotating backwards and releasing the drill.

While the above description contains many specificities, these should not be construed as limitations on the scope of the invention, but rather as an exemplification of one preferred embodiment thereof. Many other variations are possible, for example the pistol shaped appliance may be strapped to the structural member, an adjustable embodiment might be designed for an electric drill that would allow it to be tailored to a variety of different drills by adjusting the the location, height and shape of the various projections which retain the drill, an embodiment for a soldering gun might incorporate an extendable foot that would allow the device to stand on the workbench and hold the hot soldering gun between uses, or an embodiment for a hair dryer might serve only as a cord reel that clips to the dryer providing a convenient piece for the cord to be wound when not in use thus preventing the cord from becoming entangled while carrying and storing. Any embodiment for a pistol shaped appliance might be coordinated with the packaging to allow the device to become a part of the packaging thereby reducing the cost of the combination. Accordingly, the scope of the invention should be determined not by the embodiments illustrated, but by the appended claims and their legal equivalents.

I claim as my invention:

1. A device for carrying and storing a pistol shaped appliance which comprises:

(a) a rigid structural member in the shape of a plane;

(b) at least two projections from the plane of the structural member at least one of which is a releasable clamplike projection, the pistol shaped appliance being contacted at least two places on the under side for support and at least one place on the side away from the structural member to releasably secure the pistol shaped appliance to the structural member for carrying and storing;

(C) a reel means for receiving the electric cord or air hose of the pistol shaped appliance as it is wound, said reel means comprising a plurality of projections from the structural member near the periphery of the structural member, each said reel projection being spaced in from the periphery of the structural member to allow the portion of the structural member between the reel projection and the periphery of the structural member to form one side of the reel and each said reel projection having a tab bent on it's outboard end parallel to the structural member and pointing away from the center of the structural member, the tabs on the outboard end of the reel projections forming the other side of the reel.

2. A device according to claim 1 wherein the structural member contains a means for securing the free end of the electric cord or air hose.

3. A device according to claim 1 wherein the structural member contains a hole through which the user's fingers may be inserted to grip the structural member for carrying with the plane of the structural member generally vertical, or which may be positioned over a cantilevered support for storing against a generally vertical surface.

4. A device according to claim 1 wherein one of the projections contains a hole through which the barrel of the pistol shaped appliance is inserted in the process of locating and clamping the pistol shaped appliance to the structural member.

5. A device according to claim 1 wherein a cross section through the structural member and a projection is generally "J" shaped.

6. A device according to claim 1 wherein the releasable clamplike projection incorporates a spring.

7. A device according to claim 1 wherein the releasable clamplike projection incorporates a cam.

8. A device according to claim 1 wherein the releasable clamplike projection incorporates an overcenter toggle mechanism.

* * * * *